United States Patent [19]

Hehn

[11] Patent Number: 4,561,200

[45] Date of Patent: Dec. 31, 1985

[54] DISPLAY DEVICE

[75] Inventor: Bruce A. Hehn, North Canton, Ohio

[73] Assignee: Alpha Enterprises, Inc., Canton, Ohio

[21] Appl. No.: 559,327

[22] Filed: Dec. 8, 1983

[51] Int. Cl.[4] ..... G09F 1/12

[52] U.S. Cl. ..... 40/156; 40/10 P

[58] Field of Search ..... 40/10, 156, 152, 122

[56] References Cited

U.S. PATENT DOCUMENTS

| | | | |
|---|---|---|---|
| 728,921 | 5/1903 | Hough . | |
| 754,269 | 3/1904 | Witt et al. . | |
| 1,582,865 | 4/1926 | Bristol | 40/156 |
| 1,621,727 | 3/1927 | Johnson . | |
| 1,692,999 | 11/1928 | Siegel | 40/156 |
| 1,735,431 | 11/1929 | Goertz . | |
| 2,200,696 | 5/1940 | L'Heureux . | |
| 3,579,886 | 5/1971 | Hughes | 40/152 |
| 4,165,573 | 8/1979 | Richards | 40/152 |

*Primary Examiner*—Gene Mancene

*Assistant Examiner*—Wenceslao J. Contreras

*Attorney, Agent, or Firm*—Michael Sand Co.

[57] ABSTRACT

A device for displaying circular objects such as plates, pictures, mirrors and the like on a wall or other supporting structure. A frame formed with a circular-shaped central opening has a plurality of spaced lugs extending outwardly from its back surface. An annular shaped retainer ring is formed with a plurality of circumferentially spaced ramps which are engageable with the frame lugs for clamping the circular object against the back surface of the frame for visual display of the object through the frame opening. The ramps extend in an angular direction along the side of the retainer ring and provide axial movement of the retainer ring towards the frame when slidably engaged with the lugs to apply a clamping force against the circular object and to permit the mounting of objects of varying thickness on the display device. The ramps are provided with a series of ratchet teeth for locking the retainer ring in an adjustable object clamping position.

15 Claims, 11 Drawing Figures

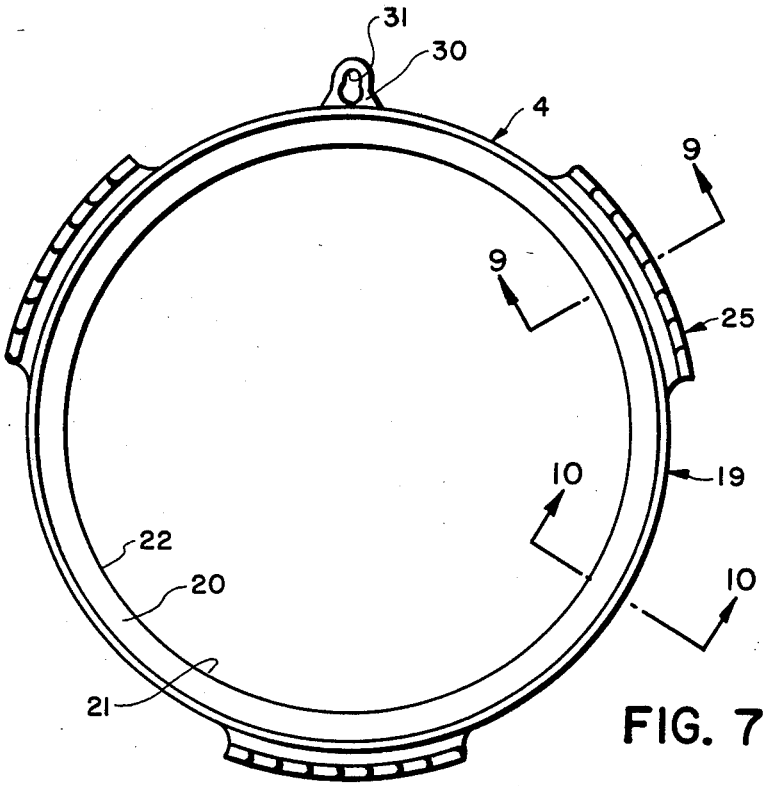
FIG. 7
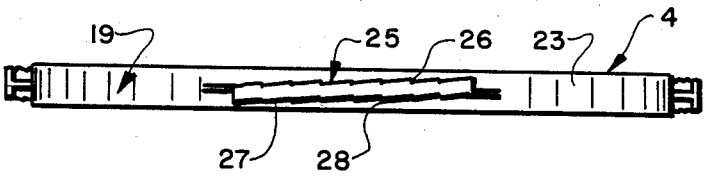
FIG. 8
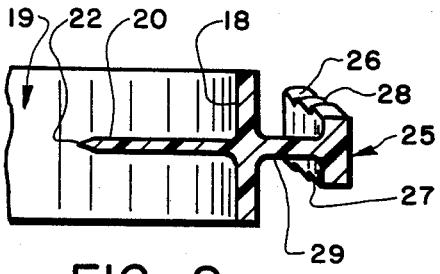
FIG. 9
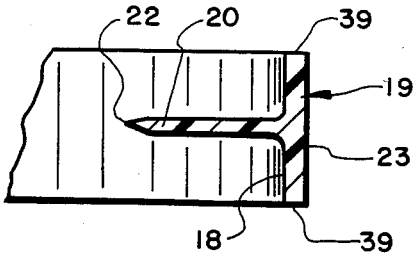
FIG. 10
FIG. 11
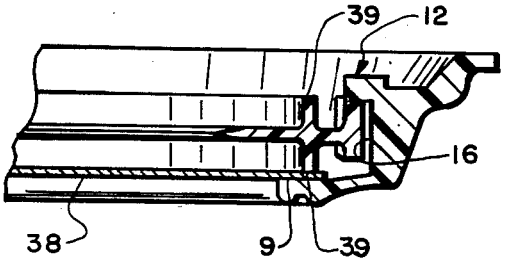

DISPLAY DEVICE

TECHNICAL FIELD

The invention relates to devices for displaying objects such as pictures, plates, mirrors, or the like, in a frame which is mounted on a wall, and in which the frame has a circular display opening. More particularly, the invention relates to such a display device in which the object to be displayed is clamped between a circular frame and a retainer ring which permits objects of various thicknesses to be mounted in the device.

BACKGROUND ART

Numerous devices have been devised for mounting and displaying objects on a wall such as mirrors, plates, pictures, and the like, in which the object is removably mounted in a frame. Heretofore, the object is retained in a mounting frame by a plurality of retaining means such as pivotally mounted tabs or by separate components which are attached to the frame and engaged with the displayed object. Although these devices perform satisfactorily they do require additional components to be manufactured and subsequently attached to the frame. Each of these separate parts and assembly thereof increases the costs of the display device.

One particular area in which display devices are used is for displaying of commemorative or limited edition plates on a wall or other usual vertical structure in which the plate will have a picture or other art work on the front surface. The frame will have a circular front opening for viewing of the artwork on the plate mounted in the frame. The frame will be provided with retaining means spaced about the inner periphery such as the above mentioned pivotally mounted tatsfor securing the plate on the frame.

Another disadvantage of such display devices for plates is that they are only useable with a very limited number of plates due to the variety of plate sizes, shapes, curvatures, etc. The display device has to closely match the particular plate to be mounted therein to insure that the desired retaining force is exerted against the plate to prevent its accidental disengagement from the frame and possible subsequent breakage since some of these plates obtain considerable value over the passage of time.

Therefore there is a need for an inexpensive display device for mounting such commemorative plates or other circular objects, which can be mass produced extremely inexpensively with a minimum number of components, and which permits plates having various curvatures and other circular objects of varying thicknesses to be mounted therein.

DISCLOSURE OF THE INVENTION

Objectives of the invention include providing an improved display device which is formed inexpensively of plastic molded components consisting of a frame and retainer ring, and in which the object to be displayed therein is clamped against the rear surface of the frame by the retainer ring. A further object is to provide such a display device in which a plurality of lugs are formed on the frame inner surface adjacent a circular display opening thereof, and in which the retainer ring is formed with a plurality of spaced, axially angularly extending ramps which are rotatably slidably engaged with the lugs to apply the desired amount of clamping pressure against the plate located therebetween.

A still further object of the invention is to provide such a display device in which the plastic material from which the frame is molded may contain dyes or other chemical to impart a decorative design to the molded frame. A still other objective is to provide such a display device in which the retainer ramps are formed with opposed ratchet teeth which are engageable with a sloped edge of the frame lugs to prevent the retainer ring from "backing off" its adjusted position against the plate, and in which the retainer ring, due to its symmetrical configuration, does not have a top or bottom thereby insuring that the ring will be properly engaged with the lugs and plate when mounted thereon to insure a firm clamping engagement with the plate and frame lugs.

Another objective of the invention is to provide such a display device in which the frame is formed with a plurality of centering buttons to insure alignment of the plate in the frame opening prior to and simultaneous with the clamping engagement of the retainer ring. Still another object is to provide such a device in which a circular object having a flat configuration, in contrast to a domed shaped plate, may also be clamped in the frame by the retainer ring by engagement of the circular edge of the retainer ring against the object to be mounted therein providing a variety of applications of the improved display device, and in which a hanger is formed integrally with the retainer ring for supporting the display device from a hook or nail on a wall or other supporting structure.

These objectives and advantages are obtained by the improved display device of the invention the general nature of which may be stated as including: a device for displaying objects such as plates, pictures, mirrors, and the like including a frame having an opening for visually displaying an object therein; a plurality of lugs mounted on an inner surface of the frame and spaced about the opening; and retainer means engageable with the lugs for clamping an object to be displayed through the frame opening against the inner surface of the frame in alignment with said frame opening.

BRIEF DESCRIPTION OF THE DRAWINGS

A preferred embodiment of the invention, illustrative of the best mode in which applicant has contemplated applying the principles, is set forth in the following description and is shown in the drawings and is distinctly pointed out and set forth in the appended claims.

FIG. 4;

FIG. 4;

FIG. 7 is a plan view of the retainer ring portion of the improved display device;

FIG. 8 is an edge view of the retainer ring portion of FIG. 7;

FIG. 9 is a greatly enlarged fragmentary sectional view taken on line 9—9, FIG. 7;

FIG. 10 is a greatly enlarged fragmentary sectional view taken on line 10—10, FIG. 7; and FIG. 11 is an enlarged fragmentary sectional view similar to FIG. 3 showing the improved display device clamping another type of circular object thereon.

Similar numerals refer to similar parts throughout the drawings.

BEST MODE FOR CARRYING OUT THE INVENTION

Figure 1:
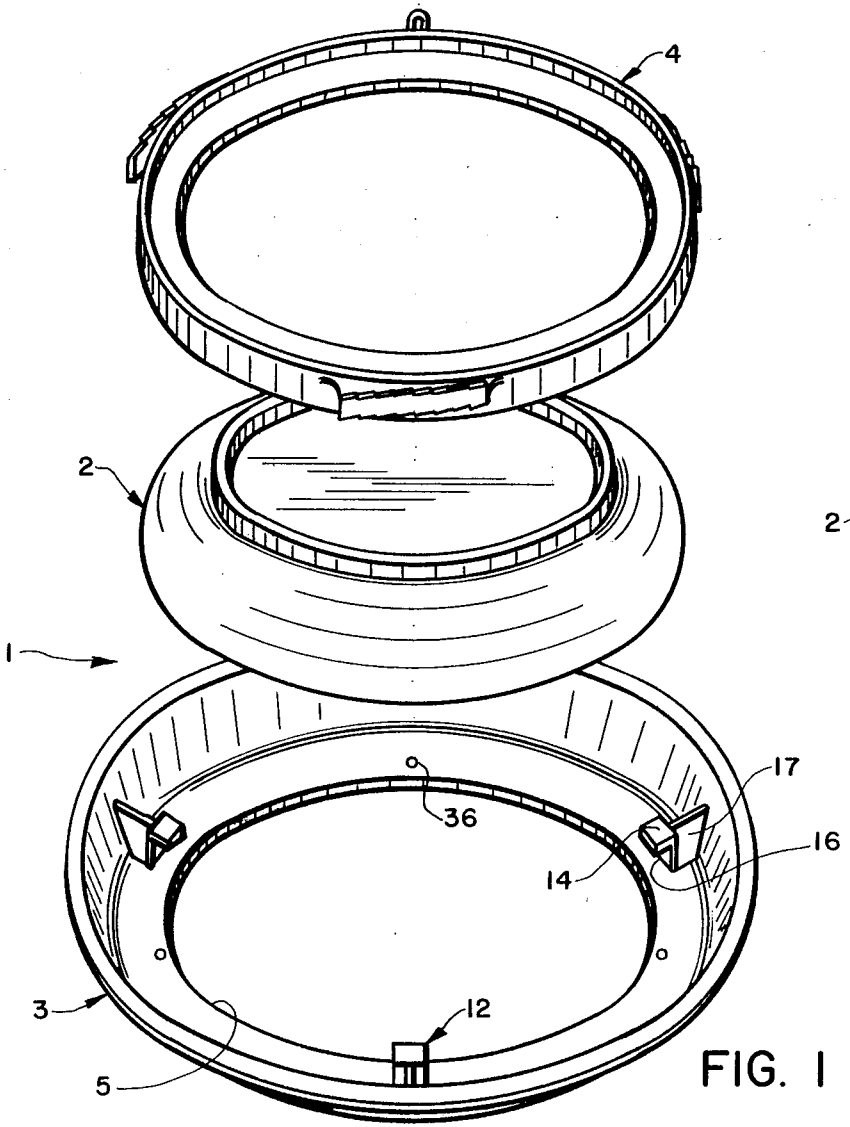
FIG. 1 is an exploded perspective view of the improved display device with a plate being shown located between the frame and retainer illustrating a type of object which may be displayed by said device.

The improved display device is indicated generally at 1, and is shown in an exploded perspective condition in FIG. 1 in combination with a plate 2 of the type to be displayed therein. Display device 1 includes only two components, a frame and retainer ring indicated generally at 3 and 4, respectively.

Figure 4:
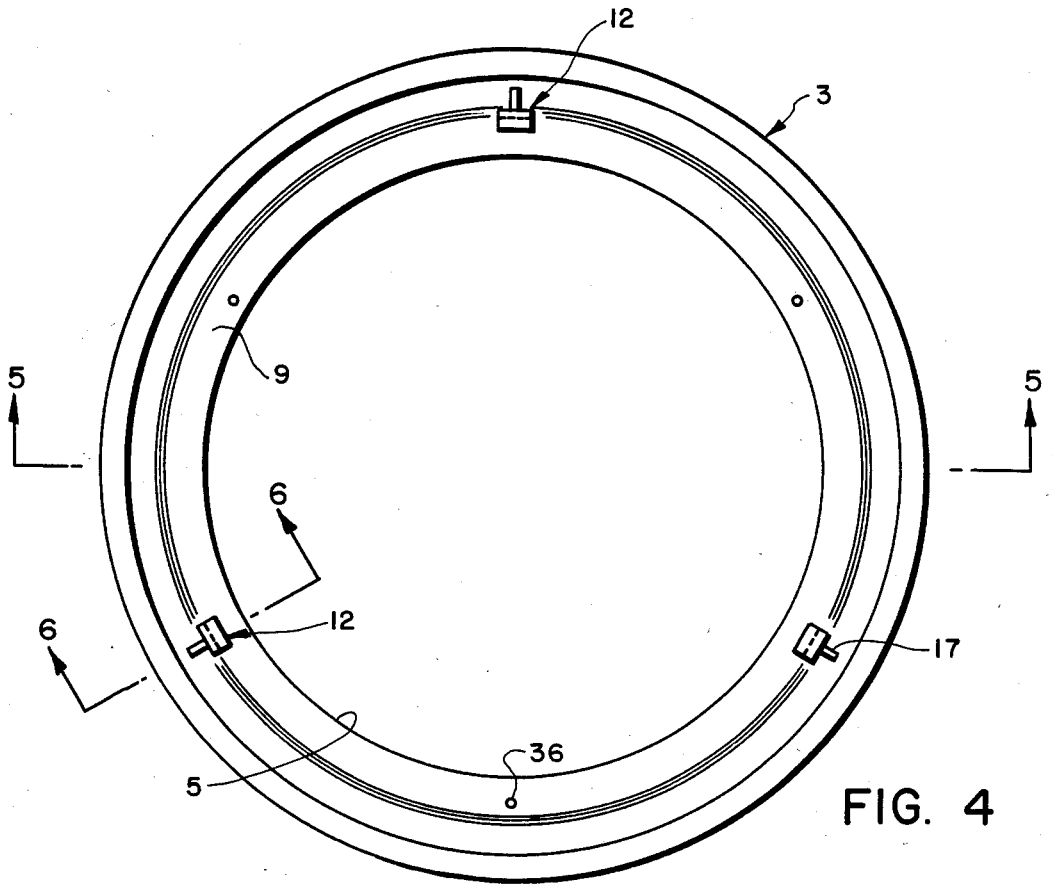
FIG. 4 is a rear plan view of the frame component of the improved display device.
Figure 5:
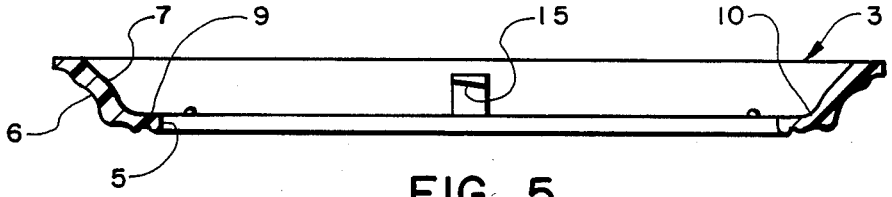
FIG. 5 is a sectional view taken on line 5—5.
Figure 6:
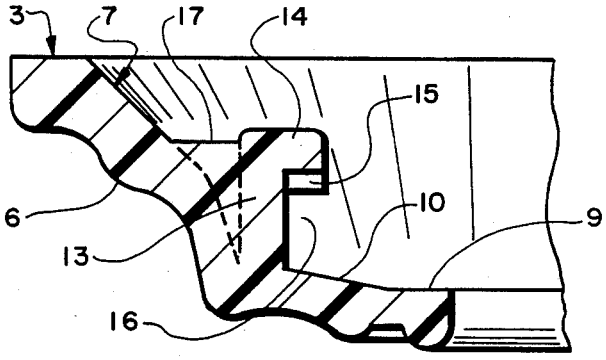
FIG. 6 is a greatly enlarged fragmentary sectional view taken on line 6—6.

Frame 3 is shown particularly in FIGS. 4–6, and has an annular configuration formed with a central circular-shaped opening 5. Frame 3 preferably has an ornamental outer surface 6 provided with a plurality of ridges and grooves to increase the aesthetic quality thereof and has an inwardly converging inner annular surface 7. Inner surface 7 includes an annular generally flat area 9 located adjacent to and surrounding frame opening 5, with an adjacent annular slightly tapered area 10 which merges with the outer steeper annular area of inner surface 7 (FIG. 6).

In accordance with one of the features of the invention, a plurality of lugs each of which is indicated generally at 12, is formed integrally with frame 3 and projects outwardly from inner surface 7. Lugs 12 each have a generally L-shaped configuration with a main vertical leg 13 and a transversely extending secondary leg 14 (FIG. 5). A reinforcing flange 17 extends between leg 13 and surface 7. Leg 14 is formed with a sloped surface 15 spaced a predetermined distance above frame areas 9 and 10 forming a slide channel 16 therebetween. Three lugs 12 are shown in the drawings and are equally spaced at approximately 120° from each other. Additional lugs may be added as desired, although three are believed to be the preferred number.

Retainer 4 shown particularly in FIGS. 7–10 is an annular ring having a cylindrical outer wall 19 and an annular clamping flange 20 extending radially inwardly from the center of the inner surface 18 of wall 19. Clamping flange 20 terminates in a tapered edge 22 which defines a circular-shaped opening 21.

In accordance with another of the main features of the invention a plurality of ramps each of which is indicated generally at 25, are formed integrally with outer wall 19 and extend in an angular or somewhat diagonal direction as shown in FIG. 8, along outer surface 23 of wall 19. Three ramps 25 are formed on retainer wall 19 at equally spaced locations, each having an arcuate length of approximately 40°. Ramps 25 extend along wall 19 the desired distance at an angle of approximately 4° with respect to an imaginary plane passing radially through wall 19.

Ramps 25 are spaced radially outwardly from wall 19 by arcuate strips of material 29 (FIG. 9) and include opposed ramp surfaces 26 and 27 provided with a series of ratchet teeth 28.

A hanger 30 is formed integrally with retainer 4 and extends radially outwardly from outer surface 23 of wall 19 and has an opening 31 formed therein for suspending the display device from a hook or nail attached to a wall or other supporting structure (FIG. 7).

Frame 3 and retainer 4 including lugs 12, ramps 25 and hanger 30 are molded inexpensively of plastic which may contain a dye to provide a variety of colors especially to the frame, such as wood grain finish or other decorative color. Preferably the color of retainer 4 will match that of frame 3 although retainer 4 is not visible when display device 1 is mounted on a wall by hanger 30.

Figure 2:
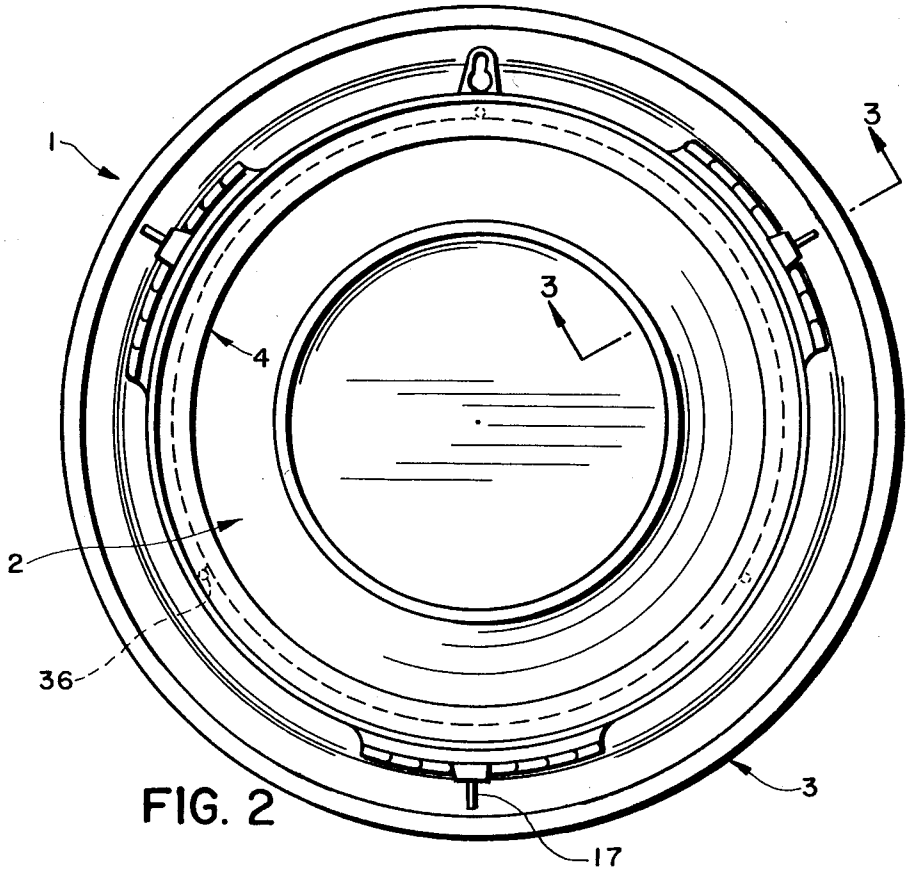
FIG. 2 is an enlarged bottom plan view of the display device of FIG.1 in assembled condition with a plate mounted thereon.
Figure 3:
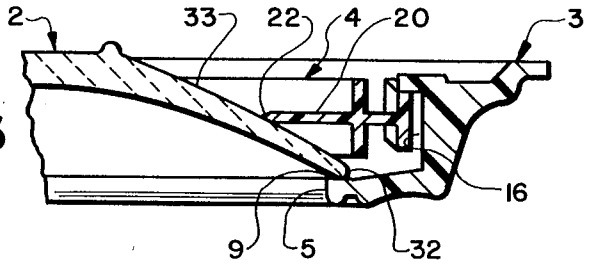
FIG. 3 is an enlarged fragmentary sectional view taken on line 3—3, FIG. 2.

Referring to FIG. 3, plate 2 is easily and firmly mounted on display device 1 by placing the outer edge 32 thereof in abutment against annular flat area 9 of frame 3. A plurality of plate centering buttons 36 preferably are formed on inner surface 7 of retainer 4 at equally spaced intervals to align plate 2 on frame 3 prior to clamping engagement between plate 2 and retainer 4.

Retainer 4 then is clampingly engaged against the rear convex surface 33 of plate 2 by aligning the ends of ramps 25 with tapered surfaces 15 of lugs 12 and rotating retainer 4. Ramps 25 will move along slide channels 16 beneath legs 14 of lugs 12 with lug surfaces 15 slidably engaging ratchet teeth 28 of the ramp surfaces. This engagement between ramps 25 and lugs 12 will advance retainer 4 in an axial direction against plate rear surface 33 forcing plate edge 32 tightly against area 9 of frame 3. Tapered edge 22 will engage plate surface 33 tightly clamping the outer plate edge 32 against frame area 9. The engagement of rachet teeth 28 with the edge of tapered surface 15 of lug legs 14 maintains retainer 4 in its adjusted clamping position with plate 2 preventing loosening of the clamping pressure. The slope of tapered edge 22 of clamping flange 20 conforms generally with the curvature of plate surface 33 providing a suitable clamping engagement between retainer 4 and the plate rear surface. Furthermore, the plastic material will not scratch or mar plate rear surface 33 or outer plate edge 32.

Retainer 4 due to the symmetrical arrangement of ramps 25 and surfaces 26 and 27 thereof and tapered edge 22 of clamping flange 20 eliminates retainer 4 from having a "top" or "bottom" surface thereby insuring proper installation of plate 2 on display device 1 regardless of the direction with which retainer 4 is pressed against plate 2 and engaged with lugs 12. Also the molding of retainer 4 of plastic will provide some flexibility and resiliency thereto enabling it to be bent when inserting the ramps beneath the retaining lugs which also assist in maintaining retainer 4 in its adjusted clamping position against plate 2.

Improved display device 1 also may be used for mounting and displaying circular objects having a flat configuration as opposed to a dome-shaped plate, as shown in FIG. 11. A flat object 38 having a circular configuration such as a picture or mirror is centered on frame 3 by centering buttons 36 and is pressed into engagement with annular flat area 9 of frame surface 7 by either circular edge 39 of retainer wall 19. Again, the ramping engagement between ramps 25 and lugs 12 will move retainer 4 axially toward frame area 9 to achieve the desired clamping pressure of wall edge 39 against object 18. Retainer 4 also may be used to clamp a flat picture, mirror or the like in frame 3 which is mounted on a dome-shaped, rectangular or triangular-shaped matting or mask.

Furthermore, device 1 can accommodate a relatively wide range of plate depths or dome curvatives by enlarging the arcuate length of ramps 25 or by modifying wall 19 of retainer 4. Changing the position of annular clamping flange 20 with respect to wall 19 will provide two different length portions of wall 19 on each side of flange 20 enabling a satisfactory clamping engagement to be obtained with different dome-shaped plates depending upon the direction that retainer 4 is mounted on frame 3.

Accordingly, the improved display device provides an extremely inexpensive means of displaying an object, preferably a circular object, of varying thickness in a frame having a circular display front opening which requires only two components that can be mass produced inexpensively of rugged plastic material in a variety of decorative colors and frame configurations, and which provides a relatively foolproof means of clamping the plate on the frame by a retainer which is necessarily installed correctly regardless of which side of the retainer is clamped against the mounted object.

Although the above description and drawings specify and show three equally spaced ramps 25 on retainer 4 and a corresponding member of lugs 12 on frame 3, this number may change without affecting the concept of the invention. Likewise, ramps 25 and surfaces 26 and 27 need not be symmetrical to enable retainer 4 to be installed correctly regardless of the direction with which it is pressed against plate 2 although such a feature is desirable to increase its effectiveness. Likewise, device 1 is reusable for mounting various objects since retainer 4 can be "backed off" to disengage ramps 25 from lugs 12 enabling the object mounted therein to be removed and replaced with a different object.

Accordingly, the improved display device is simplified, provides an effective, safe, inexpensive and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved display device is constructed and used, the characteristics of the construction, and the advantageous, new and useful results obtained; the new and useful structures, devices, elements, arrangements, parts, and combinations, are set forth in the appended claims.

What is claimed is:

1. A device for displaying an object such as a plate, picture, mirror or the like, including:

(a) a frame having an opening for visually displaying an object therein;

(b) a plurality of fixed lugs formed integrally on an inner surface of the frame and spaced about the opening; and (c) retainer means engageable with the fixed lugs for clamping an object to be displayed through the frame opening against the inner surface of the frame in alignment with said frame opening, said retainer means including an annular ring formed with a plurality of integral ramps spaced about the periphery of said ring, with said ramps being slidably engageable with the frame lugs as the ring is rotated with respect to the frame to move the ring axially toward the frame for clamping an object between said frame and ring.

2. The display device defined in claim 1, in which the ramps are provided with a series of ratchet teeth engageable with the frame lugs to retain the ring in an adjusted clamping position.

3. The display device defined in claim 2, in which the annular ring has a cylindrical side wall with the rings being formed on and projecting outwardly from said side wall; and in which the ramps extend in an angular direction a predetermined distance along said side wall.

4. The display device defined in claim 3, in which the ramps are mounted at an angle approximately 4° on the ring side wall with respect to an imaginary plane passing radially through said side wall.

5. The display device defined in claim 3, in which the ramps have two sides either of which is engageable with the lugs; and in which the ratchet teeth are formed on both sides of the lugs.

6. The display device defined in claim 1, in which each of the ramps has an arcuate length of approximately 40°.

7. The display device defined in claim 1 in which the annular ring has a cylindrical side wall with a clamping flange formed thereon and extending inwardly from said side wall for clampingly engaging the object to be displayed in the device.

8. The display device defined in claim 7 in which the clamping flange is adjustably positioned on the cylindrical side wall.

9. The display device defined in claim 7 in which the clamping flange extends radially inwardly from the midpoint of the cylindrical side wall.

10. The display device defined in claim 1 in which the frame and retainer means are formed of plastic material.

11. The display device defined in claim 1 in which the retainer means has hanger means formed on the inner surface thereof for mounting the display device on a wall.

12. The display device in claim 1 in which the lugs are generally L-shaped members having a main leg formed integrally with and projecting outwardly from the inner surface of the frame and a secondary leg extending generally perpendicularly from said main leg and having an angled surface engageable with the retainer means.

13. The display device defined in claim 1 in which the frame has an annular shape with the opening being circular.

14. The display device defined in claim 13 in which the object to be mounted thereon is a circular plate.

15. The display device defined in claim 1 in which a plurality of button means are formed in spaced relationship on the inner surface of the frame for centering an object to be mounted on the display device with respect to the frame opening.

* * * * *